US007895980B2

(12) United States Patent
Hayashi

(10) Patent No.: US 7,895,980 B2
(45) Date of Patent: Mar. 1, 2011

(54) VALVE TIMING ADJUSTING DEVICE

(75) Inventor: Masashi Hayashi, Okazaki (JP)

(73) Assignee: Denso Corporation, Kariya (JP)

( * ) Notice: Subject to any disclaimer, the term of this patent is extended or adjusted under 35 U.S.C. 154(b) by 324 days.

(21) Appl. No.: 12/269,080

(22) Filed: Nov. 12, 2008

(65) Prior Publication Data

US 2009/0126664 A1 May 21, 2009

(30) Foreign Application Priority Data

Nov. 16, 2007 (JP) ..... 2007-297896

(51) Int. Cl.
*F01L 1/34* (2006.01)

(52) U.S. Cl. ..... 123/90.17; 123/90.31; 123/90.15

(58) Field of Classification Search ..... 123/90.15, 123/90.17, 90.31
See application file for complete search history.

(56) References Cited

U.S. PATENT DOCUMENTS 6,439,184 B1 * 8/2002 Takenaka et al. ..... 123/90.17

FOREIGN PATENT DOCUMENTS

| | | |
|---|---|---|
| JP | 2005-36760 | 2/2005 |
| JP | 2007-138730 | 6/2007 |
| JP | 2007-270625 | 10/2007 |

* cited by examiner

*Primary Examiner*—Zelalem Eshete
(74) *Attorney, Agent, or Firm*—Nixon & Vanderhye PC

(57) ABSTRACT

A valve timing adjusting device includes a housing, a first vane rotor, a second vane rotor, a biasing device, and a limiting device. The second vane rotor is coaxial with the first vane rotor. The biasing device has a first end engaged with the first vane rotor and a second end engaged with the second vane rotor. The biasing device biases one of the first and second vane rotors in the advance direction, and biases the other one in the retard direction. The limiting device allows the first vane rotor to rotate relative to the second vane rotor when pressure of working fluid is lower than a preset level, and limits the first vane rotor from rotating relatively when the pressure is not lower than the preset level.

4 Claims, 15 Drawing Sheets

VALVE TIMING ADJUSTING DEVICE

CROSS REFERENCE TO RELATED APPLICATION

This application is based on and incorporates herein by reference Japanese Patent Application No. 2007-297896 filed on Nov. 16, 2007.

BACKGROUND OF THE INVENTION

1. Field of the Invention

The present invention relates to a valve timing adjusting device which controls timing of opening and closing at least one of an intake valve and an exhaust valve in an internal combustion engine. Hereinafter, the above timing of opening and closing is referred to as valve timing.

2. Description of Related Art

Conventionally, a valve timing adjusting device that controls timing of opening and closing at least one of an intake valve and an exhaust valve in an internal combustion engine has improved the startability of the engine by a phase control for advancing and retarding valve timing at the start of the engine. As a known technique to assure high startability after a failure such as an engine stall, a return spring is mounted in a valve timing adjusting device for the phase control as described in JP-A-2007-138730. Typically, the phase control is performed for adjusting a phase relation between a crankshaft and a camshaft in the internal combustion engine.

However, in a case, where a return spring is mounted over a housing and a vane rotor of the valve timing adjusting device as described in JP-A-2007-138730, a biasing force of the return spring changes between (a) when the vane rotor of the device is positioned at in the most advance position and (b) when the vane rotor is positioned at the most retard position. As a result, the difference of the biasing force influences the phase control caused by working fluid pressure, and thereby making precise phase control difficult.

Because an average cam torque is large at the start of the engine at a very low temperature, the return spring biasing force is required to be increased. However, in a case, where the return spring biasing force is increased, the precise phase control by using the working fluid pressure may become difficult in normal operation of the engine disadvantageously. As a result, in the valve timing adjusting device, the return spring biasing force is required to be set to a level, which does not substantially influence the phase control in normal operation of the engine.

SUMMARY OF THE INVENTION

The present invention is made in view of the above disadvantages. Thus, it is an objective of the present invention to address at least one of the above disadvantages.

To achieve the objective of the present invention, there is provided a valve timing adjusting device for an internal combustion engine, wherein the valve timing adjusting device is provided in a driving force transmission system of the engine, which transmits a driving force from a drive shaft to a driven shaft for opening and closing at least one of an intake valve and an exhaust valve, wherein the valve timing adjusting device adjusts timing of opening and closing the at least one of the intake valve and the exhaust valve. The valve timing adjusting device includes a housing, a first vane rotor, a second vane rotor, a biasing device, and a limiting device. The housing is rotatable together with one of the drive shaft and the driven shaft. The housing defines a plurality of receiving chambers therein, each of which is circumferentially defined within a given angular range. The first vane rotor is rotatable together with the other one of the drive shaft and the driven shaft. The first vane rotor partitions a first one of the plurality of receiving chambers into a first retard chamber and a first advance chamber. The first vane rotor is rotatable relatively to the housing in a retard direction and an advance direction, which is opposite to the retard direction, by pressure of working fluid supplied to the first retard chamber and the first advance chamber. The second vane rotor is positioned coaxially with the first vane rotor. The second vane rotor is rotatable relatively to the drive shaft and the driven shaft. The second vane rotor partitions a second one of the plurality of receiving chambers into a second retard chamber and a second advance chamber. The second vane rotor is rotatable relatively to the housing in the retard direction and the advance direction by pressure of working fluid supplied to the second retard chamber and the second advance chamber. The biasing device has a first end engaged with the first vane rotor and a second end engaged with the second vane rotor. The biasing device biases one of the first vane rotor and the second vane rotor in the advance direction. The biasing device biases the other one of the first vane rotor and the second vane rotor in the retard direction. The limiting device allows the first vane rotor to rotate relative to the second vane rotor when pressure of working fluid supplied from an external fluid supplier is lower than a preset level. The limiting device limits the first vane rotor from rotating relative to the second vane rotor when the pressure of working fluid supplied from the fluid supplier is equal to or higher than the preset level.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Next, the preferred embodiments of the present invention will be described in detail referring to the accompanying drawings.

First Embodiment

FIGS. 1 to 9 show a valve timing adjusting device 1 according to a first embodiment of the present invention. In the present embodiment, the valve timing adjusting device 1 is a hydraulic control system, which uses hydraulic oil as a working fluid, and which controls valve timing to set the exhaust valve of an internal combustion engine to an advance position at the start of the engine. In other words, the valve timing adjusting device 1 controls the engine phase to advance valve timing at the start of the engine. Typically, the engine phase indicates a phase relation between a crankshaft and a camshaft in the internal combustion engine.

Figure 1:
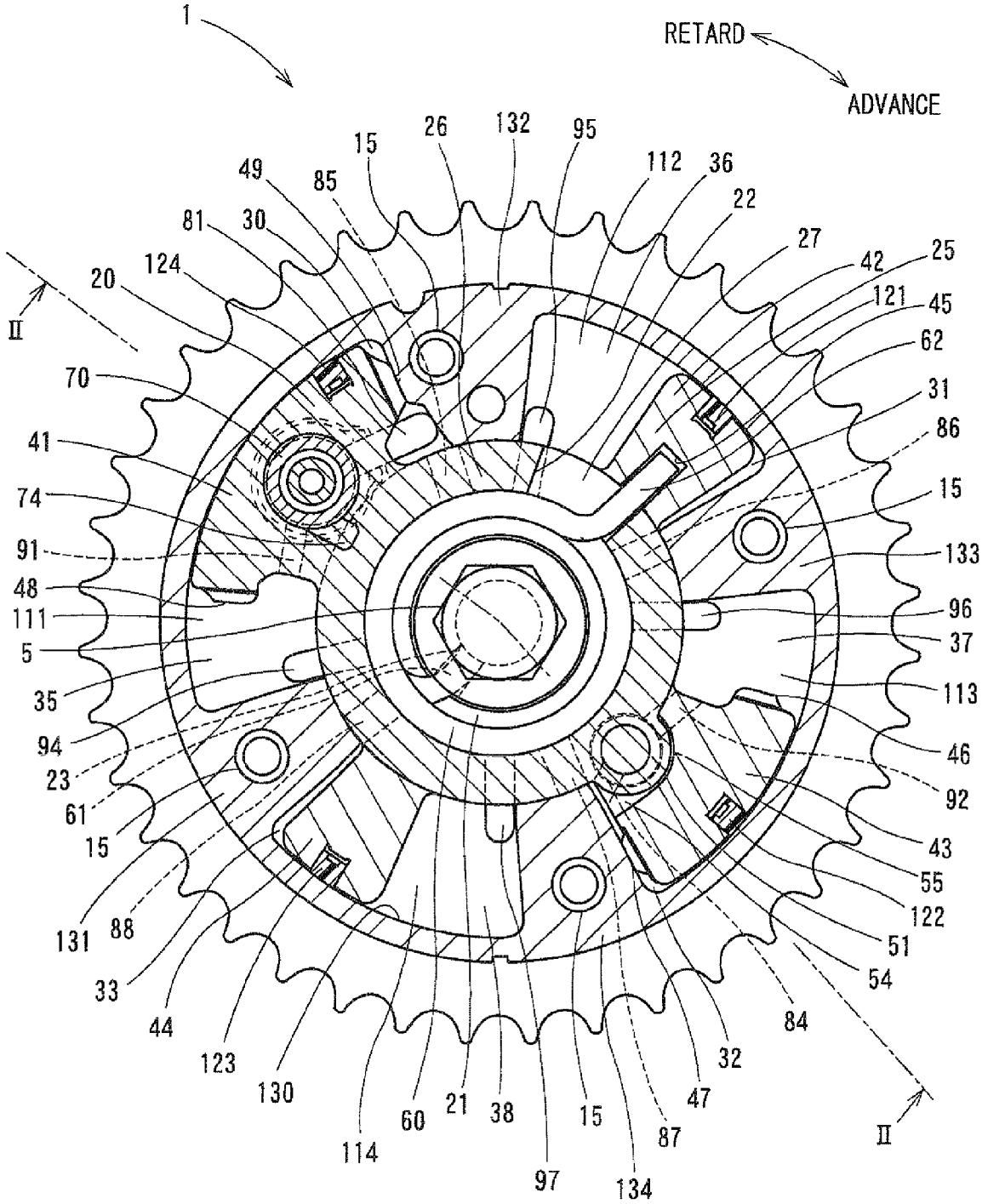
FIG. 1 is a sectional view taken along the line I-I in FIG. 2 showing a valve timing adjusting device in a first embodiment of the present invention.
Figure 2:
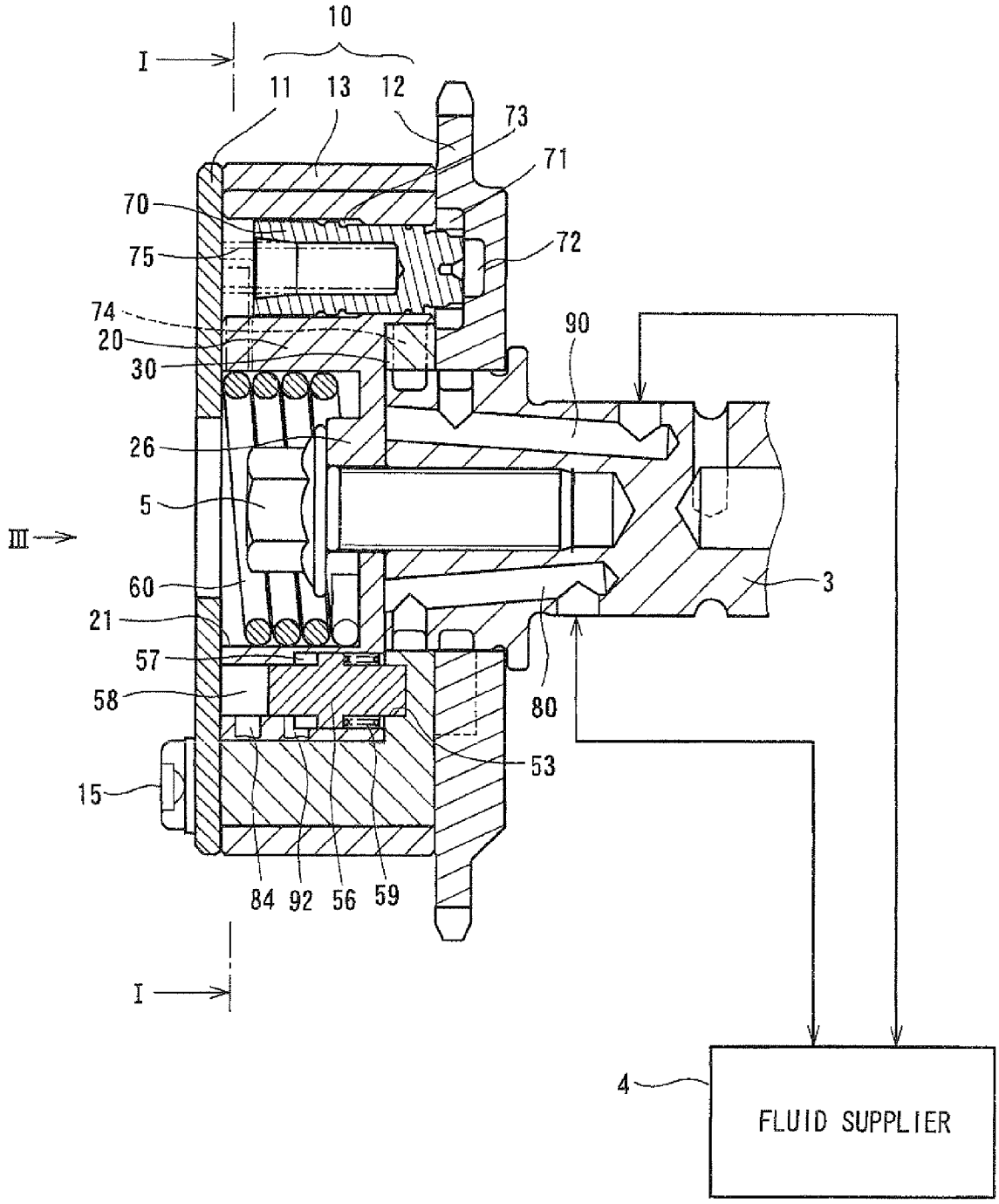
FIG. 2 is a sectional view taken along the line II-II in FIG. 1 showing the valve timing adjusting device in the first embodiment.
Figure 3:
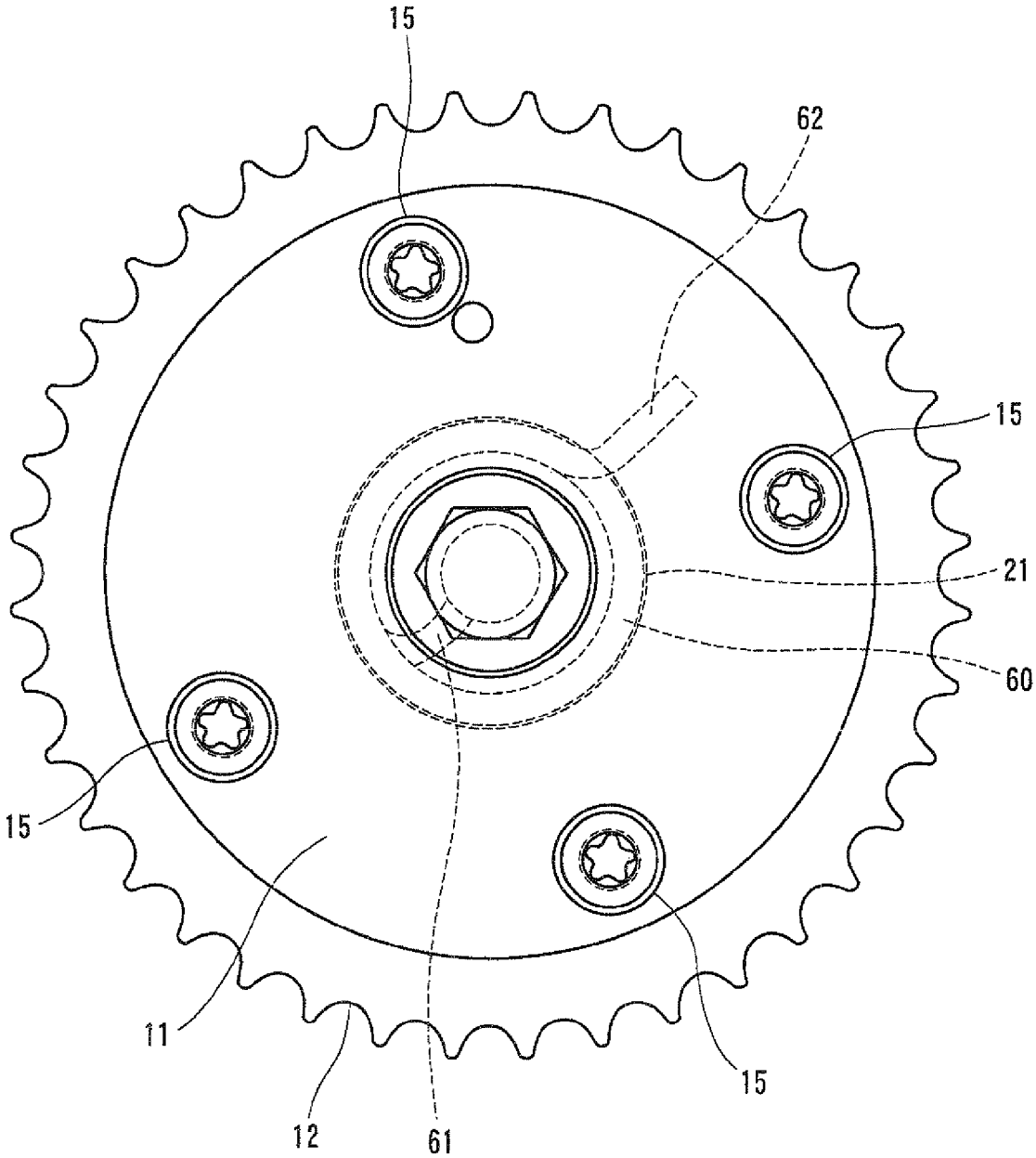
FIG. 3 is a plan view from direction III in FIG. 2 showing the valve timing adjusting device in the first embodiment.
Figure 4:
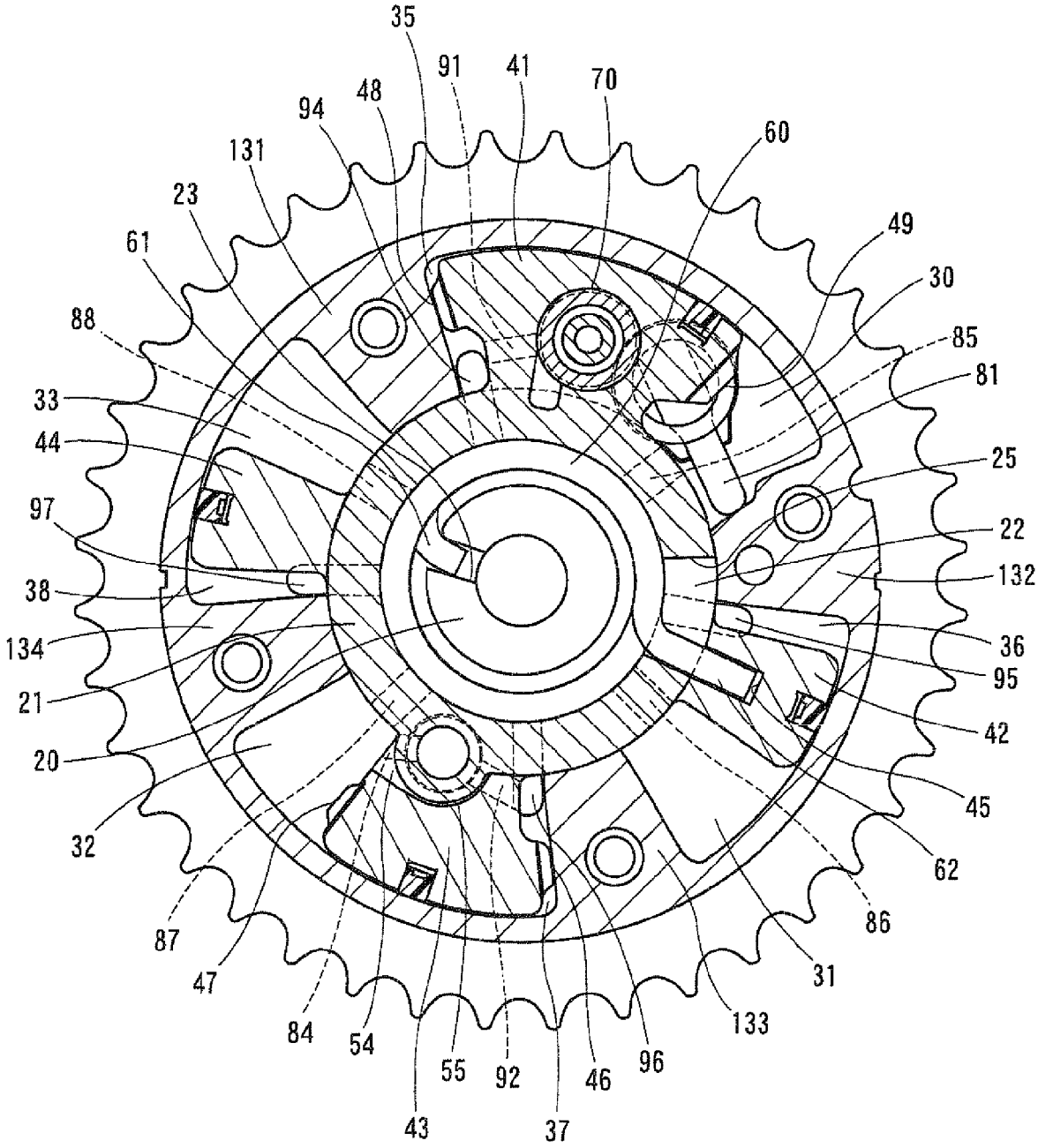
FIG. 4 shows an operational state of the valve timing adjusting device in the first embodiment at a time immediately after engine stop.
Figure 5:
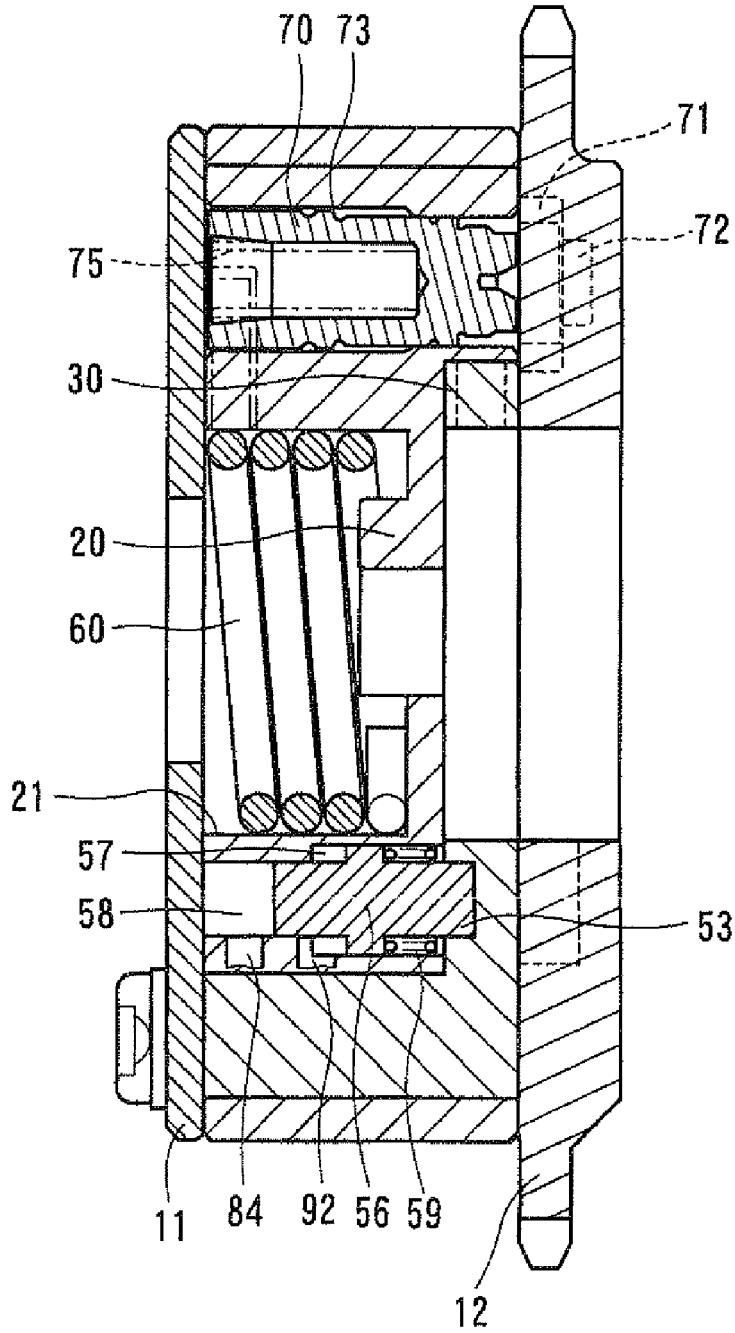
FIG. 5 shows an operational state of the valve timing adjusting device in the first embodiment at a time immediately after the engine stop.
Figure 6:
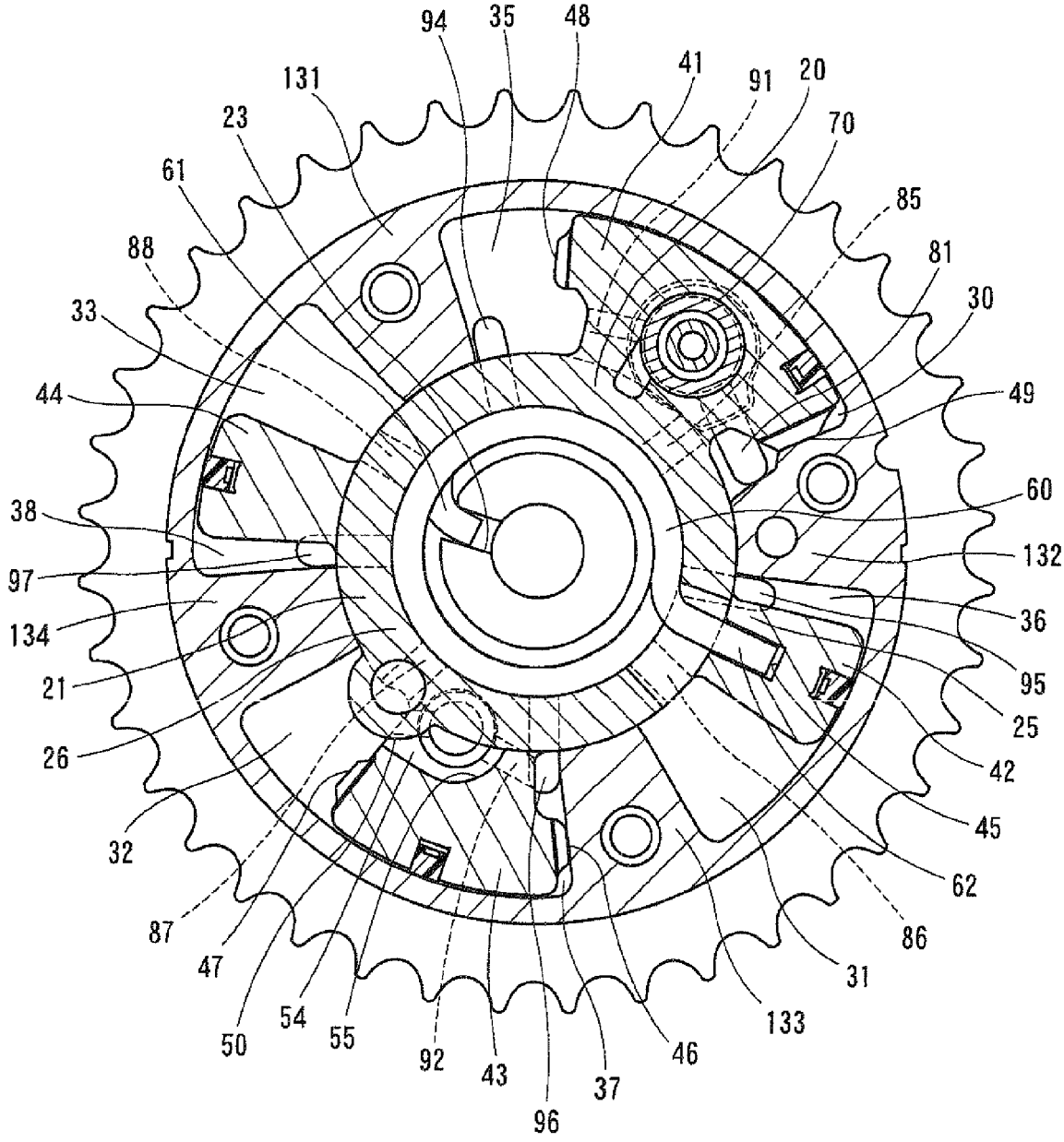
FIG. 6 shows an operational state of the valve timing adjusting device in the first embodiment in the course of or after engine stop or in the course of engine start.
Figure 7:
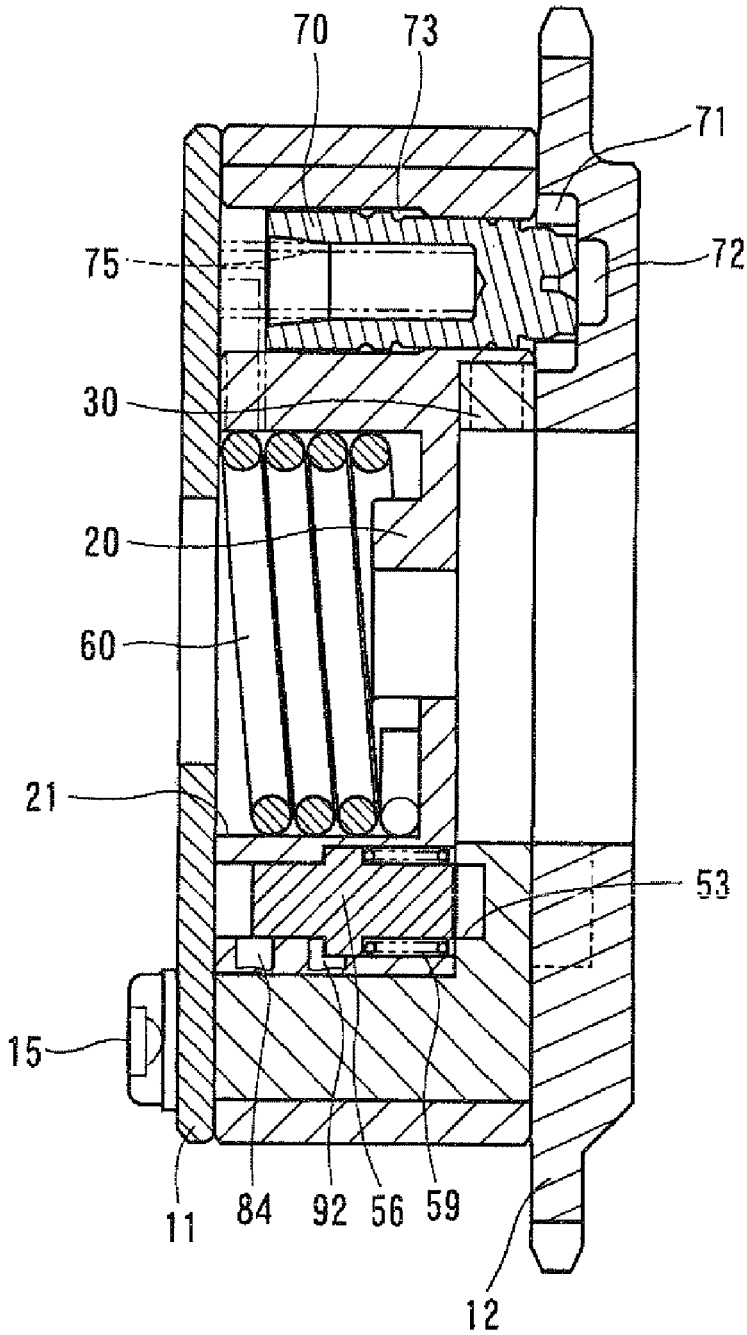
FIG. 7 shows an operational state of the valve timing adjusting device in the first embodiment in the course of or after engine stop or in the course of engine start.
Figure 8:
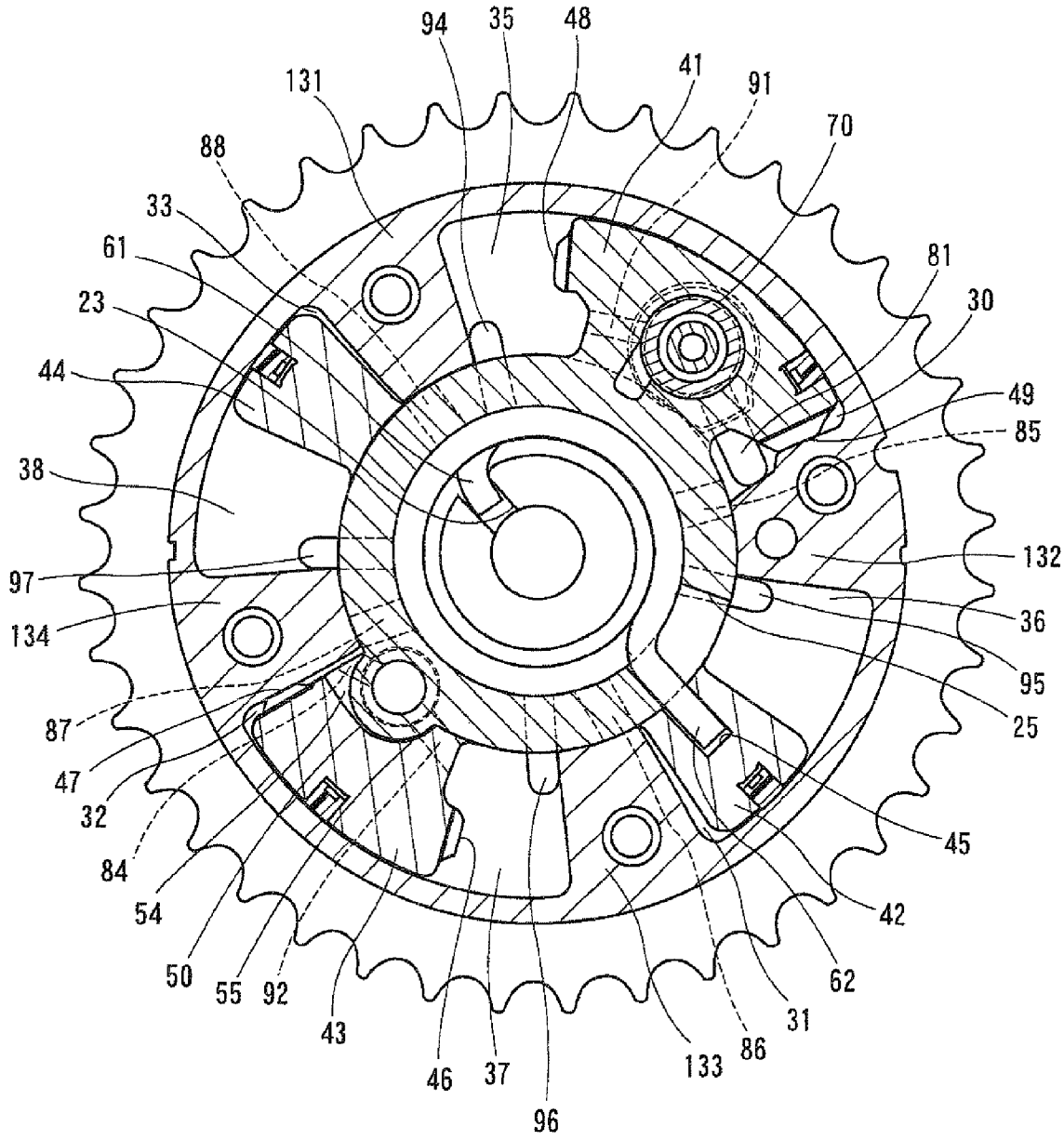
FIG. 8 shows an operational state of the valve timing adjusting device in the first embodiment after engine start.
Figure 9:
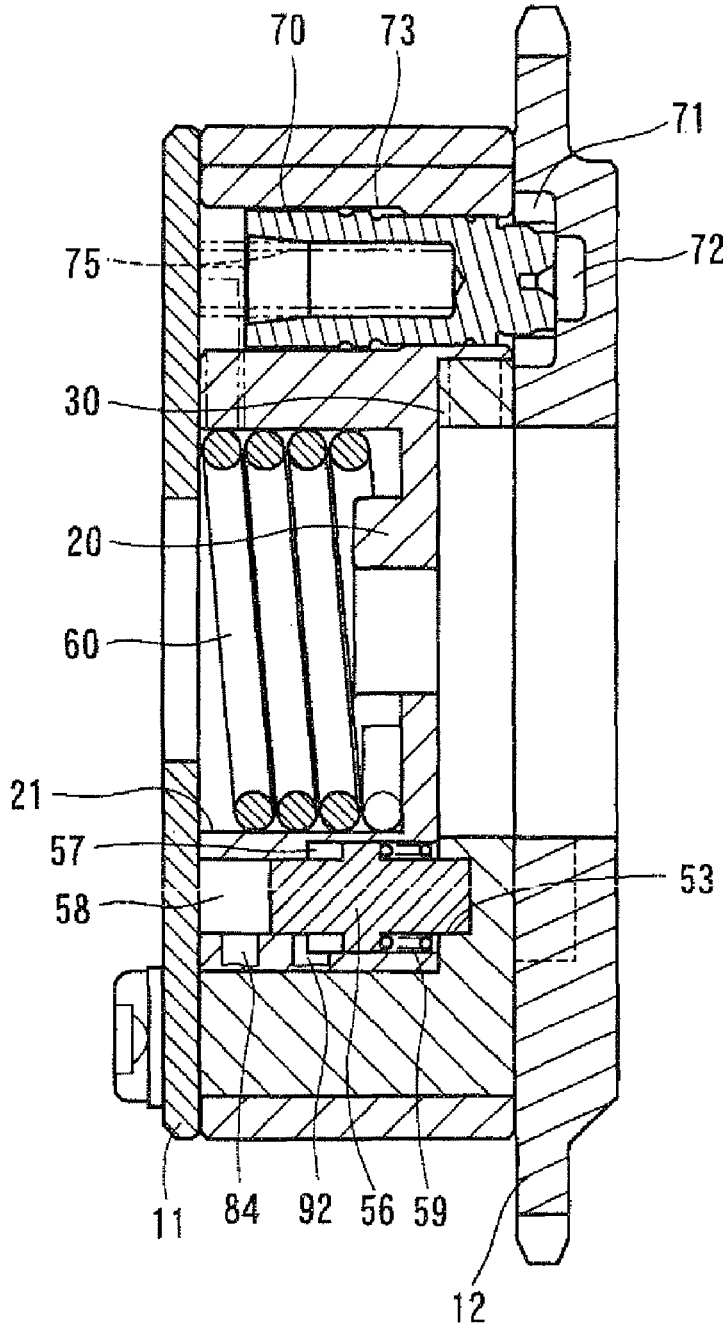
FIG. 9 shows an operational state of the valve timing adjusting device in the first embodiment after engine start.

FIGS. 1 to 3 show the mechanical structure of the valve timing adjusting device 1. Each of FIGS. 4, 5 shows an operational state of the valve timing adjusting device 1 at a time immediately after the stop of the internal combustion engine. Each of FIGS. 6, 7 shows an operational state of the device 1 in the course of engine stop. Each of FIGS. 8, 9 shows an operational state of the device 1 in time immediately after the engine start.

First, the mechanical structure of the valve timing adjusting device 1 is explained referring to FIGS. 1 to 3. The valve timing adjusting device 1 in the present embodiment includes a housing 10, a first vane rotor 20, a second vane rotor 25, a fitting pin 56 (limiting device), and a return spring 60 (biasing device).

As shown in FIG. 2, the housing 10 as a driving rotator includes a chain sprocket 12, a shoe housing 13, and a front plate 11. As shown in FIG. 1, the shoe housing 13 includes shoes 131, 132, 133, 134 (partition members) and a circular peripheral wall 130, which are all integrally formed. The trapezoidal shoes 131, 132, 133, 134, which extend radially inwardly from the peripheral wall 130, are circumferentially disposed at generally regular intervals in the direction of rotation of the peripheral wall 130. A receiving chamber 111 is provided between the shoes 131 and 132, a receiving chamber 112 between the shoes 132 and 133, a receiving chamber 113 between the shoes 133 and 134, and a receiving chamber 114 between the shoes 134 and 131.

As illustrated in FIGS. 2, 3, the shoe housing 13 and front plate 11 are fixed coaxially with the chain sprocket 12 through bolts 15. Coupled with the crankshaft (not shown) serving as the drive shaft of the internal combustion engine, the chain sprocket 12 receives a driving force from the crankshaft and is rotatable together with the crankshaft. The driving force of the crankshaft is transmitted through the valve timing adjusting device 1 to a camshaft 3 (driven shaft) and opens and closes an intake valve (not shown). The camshaft 3 is received in the chain sprocket 12 such that the camshaft 3 is capable of rotating relatively with respect to the chain sprocket 12.

The first vane rotor 20 as a driven rotator is in contact with one axial end face of the camshaft 3, and the camshaft 3 and the first vane rotor 20 are coupled coaxially by the bolt 5. The positioning of the first vane rotor 20 and camshaft 3 in the rotational direction is made by fitting a positioning pin (not shown) into the first vane rotor 20 and the camshaft 3 or by a similar method. The camshaft 3, housing 10, and first vane rotor 20 rotate clockwise as viewed in FIG. 1. Hereinafter this rotational direction is referred to as the advance direction of the camshaft 3 with respect to the crankshaft. The first vane rotor 20 is housed in the housing 10 in a way that the first vane rotor 20 is capable of rotating relatively with respect to the housing 10. As illustrated in FIG. 1, the first vane rotor 20 has a cylindrical boss 26, which is fixed on the camshaft 3, and a first vane 41, which is formed on a radially outer side of the first vane rotor 20. The first vane 41 is in slidable contact with a radially outer side of a boss 27 of a second vane rotor 25 (described later) and rotatably housed in the receiving chamber 111. The first vane 41 partitions the receiving chamber 111 into an advance chamber 35 (first advance chamber) and a retard chamber 30 (first retard chamber).

The arrows in FIG. 1, which indicate the retard and advance directions respectively, represent the retard and advance directions of the first vane rotor 20 with respect to the housing 10. The first vane 41 has a contact portion 49, which contacts the shoe 132, and a contact portion 48, which contacts the shoe 131. The contact portions 48, 49 limit the range of rotation of the first vane rotor 20 by contacting the shoes 131, 132, respectively.

The second vane rotor 25 is located in the housing 10 coaxially with the first vane rotor 20 and is in slidable contact with the camshaft 3 on a side of the first vane rotor 20 toward the chain sprocket 12. The second vane rotor 25 is provided rotatably relative to the housing 10 and the first vane rotor 20. As illustrated in FIG. 1, the second vane rotor 25 has a cylindrical boss 27, which is in contact with the camshaft 3, and second vanes 42, 43, and 44, which are formed radially outer side of the second vane rotor 25. The second vanes 42, 43, and 44 slidably contact the radially outer side of the boss 26 of the first vane rotor 20 and are rotatably or movably housed in the receiving chambers 112, 113, and 114, respectively.

The second vane 42 partitions the receiving chamber 112 into an advance chamber 36 and a retard chamber 31. The second vane 43 partitions the receiving chamber 113 into an advance chamber 37 (second advance chamber) and a retard chamber 32 (second retard chamber). The second vane 44 partitions the receiving chamber 114 into an advance chamber 38 and a retard chamber 33. The arrows in FIG. 1, which indicate the retard and advance directions, represent the retard and advance directions of the second vane rotor 25 with respect to the housing 10. The second vane 43 has a contact portion 46, which contacts the shoe 133, and a contact portion 47, which contacts the shoe 134. The contact portions 46, 47 limit the range of rotation of the second vane rotor 25 by contacting the shoes 133, 134, respectively.

The fitting pin 56 as a limiting device is housed reciprocably in hydraulic chambers 57, 58 of the first vane rotor 20. The boss 26 has a contact portion 50, which radially outwardly projects from the boss 26, and the hydraulic chambers 57, 58 are provided to the contact portion 50. The second vane rotor 25 has a hole formation part 54 at a position correspondingly to the contact portion 50. A fitting hole 53 is formed in the hole formation part 54. The fitting pin 56 is fittable into the fitting hole 53. The fitting pin 56, which as a cylindrical shape with a shoulder or a large diameter portion, is biased by a spring 59 in the direction away from the fitting hole 53 such that the fitting pin 56 is disengaged from the fitting hole 53. The biasing force of the spring 59 is set to a higher level than the working fluid pressure at the stop of the engine. The hydraulic chamber 57 is communicated with the advance chamber 37 through an advance passage 92. The hydraulic chamber 58 is communicated with the retard chamber 32 through a retard passage 84. The pressure of the working fluid supplied to the hydraulic chambers 57, 58 is applied in a direction to push the fitting pin 56 into the fitting hole 53.

The hole formation part 54 has a contact portion 55 that extends or stands axially. The fitting hole 53 is provided at a position that axially overlaps the fitting pin 56 when the contact portion 50 and the contact portion 55 contact each other. When the fitting hole 53 and the fitting pin 56 are axially overlapping with each other and the working fluid pressure is equal to or greater than the biasing force of the spring 59, the fitting pin 56 is fitted into the fitting hole 53. When the working fluid pressure is below the biasing force of the spring 59, the fitting pin 56 is taken out of or released from the fitting hole 53.

The return spring 60 is compressedly housed in a cylindrical receiving chamber 21, which has a bottom, and which is formed on the boss 26 of the first vane rotor 20. The boss 26 of the first vane rotor 20 has a mounting groove 23, which is radially inwardly recessed on the boss 26. A mounting groove 45 is formed in the vane 42 of the second vane rotor 25 as an outward recess in the radial direction. The return spring 60 has one end 61 (first end), which is engaged with the mounting groove 23, and the other end 62, which is engaged with the mounting groove 45.

The boss 26 defines a notch 22 that is configured to extend in a range, in which the other end 62 of the return spring 60 is reciprocable in the receiving chamber 112. Also, the notch 22 is provided to extend in a region that limits leakage of working fluid between the advance chamber 36 and the retard chamber 31. The return spring 60 biases the first vane rotor 20 clockwise as viewed in FIG. 1 and biases the second vane rotor 25 counterclockwise. The biasing force of the return spring 60 is set to a lower level than the working fluid pressure in normal operation of the engine, in which the valve timing adjusting device 1 is mounted. Typically, the biasing force of the return spring 60 is set to an average cam torque at the start of the engine at a very low temperature.

A stopper piston 70 as a cylindrical fitting member is housed in a through hole in the first vane 41 such that the stopper piston 70 is reciprocable in the rotation axis direction. A fitting ring 71 is press-fitted in a recess in the chain sprocket 12. The stopper piston 70 is fittable in the fitting ring 71. A spring 75 biases the stopper piston 70 toward the fitting ring 71. The stopper piston 70, the fitting ring 71, and the spring 75 constitute a restriction mechanism, which limits the first vane 41 and the first vane rotor 20 from rotating relative to the housing 10.

The pressure of the working fluid supplied to a hydraulic chamber 72, which is formed on the chain sprocket 12 side of the stopper piston 70, and to a hydraulic chamber 73, which is formed on the radially outer side of the stopper piston 70, is applied to the stopper piston 70 in a direction away from the fitting ring 71 such that the stopper piston 70 is taken out of the fitting ring 71. The hydraulic chamber 72 is communicated with the retard chamber 30 through the retard passage 81. The tip of the stopper piston 70 is fitted in the fitting ring 71 when the first vane rotor 20 is at the most advance position with respect to the housing 10. When the stopper piston 70 fits in the fitting ring 71, relative rotation of the first vane rotor 20 with respect to the housing 10 is limited. A back pressure relief groove 74 is provided on a side the first vane 41, which side faces in a direction toward the fitting ring 70. For example, the back pressure relief groove 74 releases the back pressure that varies with sliding motion of the stopper piston. As the first vane rotor 20 rotates with respect to the housing 10 from the most advance position in the retard direction, the stopper piston 70 and fitting ring 71 become displaced from each other, and the stopper piston 70 is disabled to fit into the fitting ring 71.

Seal members 121, 122, 123, and 124 are located in sliding gaps between (a) the peripheral wall 130 of the shoe housing 13 and (b) each of the first vane 41 and second vanes 42, 43, and 44 that face the peripheral wall 130 in the radial direction. The seal members 121, 122, 123, and 124 are fitted in grooves in the radially outer walls of the first vane 41 and second vanes 42, 43, and 44, and radially outwardly biased toward the inner side of the peripheral wall 130 by springs or the like. Thus the seal members 121, 122, 123, and 124 limit the working fluid from leaking between the respective retard chambers and advance chambers.

A fluid supplier 4 shown in FIG. 2 includes a hydraulic pump and a phase changeover valve. The fluid supplier 4 generates a hydraulic pressure which varies depending on the rotation speed of the engine, and changes the function of an advance passage 90 and a retard passage 80 between a working fluid supply passage and a working fluid discharge passage. The advance passage 90 and the retard passage 80 are always communicated with supply and discharge ports of the fluid supplier 4. As illustrated in FIG. 1, the advance passage 90, which branches into advance passages 94, 95, 96, and 97, supplies working fluid to the advance chambers 35, 36, 37, and 38, respectively. Also, the advance passage 90 discharges working fluid from the respective advance chambers to an oil pan (not shown). The retard passage 80, which branches into retard passages 85, 86, 87, an 88, supplies working fluid to the retard chambers 30, 31, 32, and 33, respectively. Also, the retard passage 80 discharges working fluid from the respective retard chambers to the oil pan (not shown). The above means that the advance passages function as both advance supply passages and advance discharge passages, and the retard passages function as both retard supply passages and retard discharge passages. Thus, working fluid can be supplied from the fluid supplier 4 to the advance chambers 35-38 and the retard chambers 30-33 and discharged from the chambers.

Next, an operation of the valve timing adjusting device will be described.

(Operation at a Time Immediately After Engine Stop)

FIGS. 4, 5 show the valve timing adjusting device just after engine stop. The figures show that the engine is stopped in a state, where the valve timing adjusting device 1 is set to a retard position by phase control. More specifically, in the valve timing adjusting device 1, until just before the engine stops, working fluid is supplied from the fluid supplier 4 to the retard chambers 30, 31, 32, and 33 through the retard passage 80 (85, 86, 87, 88). Thus, the working fluid pressure rotates the first vane rotor 20 and the second vane rotor 25 in the retard direction with respect to the housing 10, and the working fluid in the advance chambers 35, 36, 37, and 38 is discharged to the oil pan through the advance passages 94, 95, 96, and 97; as a consequence the engine stops.

In the valve timing adjusting device, just before engine stop, working fluid is supplied from the retard chamber 32 to the hydraulic chamber 58 through the retard passage 84, and working fluid is supplied from the advance chamber 37 to the hydraulic chamber 57 through the advance passage 92. Therefore, in the valve timing adjusting device 1, at a time immediately after engine stop, the working fluid pressure in the hydraulic chambers 58, 57 is applied against a preset biasing force of the spring 59 so that the fitting pin 56 fits in the fitting hole 53. In addition, the stopper piston 70 is not in alignment with the fitting ring 71 and cannot fit in it.

(Operation in the Course of or After Engine Stop or in the Course of Engine Start)

FIGS. 6, 7 show a state, where the engine stops and no working fluid is supplied from the fluid supplier to the valve timing adjusting device, and thereby the working fluid pressure is below a preset level. Because no working fluid is supplied to the valve timing adjusting device 1 in the course of or after engine stop, the working fluid pressure in the hydraulic chamber 57 and the working fluid pressure in the hydraulic chamber 58 fall below the preset level. In the above, the hydraulic chamber 57 is communicated with the advance chamber 37 through the advance passage 92, and the hydraulic chamber 58 is communicated with the retard chamber 32 through the retard passage 84. Consequently, the fitting pin 56 is forcibly taken out of the fitting hole 53 by the preset biasing force of the spring 59 in the course of engine stop or start.

As the fitting pin 56 is taken out of the fitting hole 53, the return spring 60, which biases the first vane rotor 20 clockwise as viewed in FIG. 6, and which biases the second vane rotor 25 counterclockwise, causes the first vane rotor 20 and second vane rotor 25 to rotate in opposite directions. At this time, the contact portion 46 of the second vane 43 contacts the shoe 133, which limits relative rotation of the second vane rotor 25 in the retard direction with respect to the housing 10. Therefore, the first vane rotor 20 rotates in the advance direction with respect to the housing 10. Then, the contact portion 49 of the first vane 41 contacts the shoe 132, which limits relative rotation of the first vane rotor 20 in the advance direction with respect to the housing 10. Because the first vane rotor 20 is coupled with the camshaft 3, the phase of the valve timing adjusting device 1 reaches the advance position.

When the first vane 41 is in the most advance position, the stopper piston 70 and fitting ring 71 are axially overlap with each other, and thereby the stopper piston 70 is fitted in the fitting ring 71 by the biasing force of the spring 75.

(Operation After Engine Start)

FIGS. 8, 9 show a state, where after the engine is started, and thereby working fluid is supplied to the valve timing adjusting device for performing the advance control for advancing valve timing. As the engine is started, working fluid is supplied to the advance chambers 35, 36, 37, 38 through the advance passages 90, 94, 95, 96, 97. The working fluid pressure is applied to the second vanes 42, 43, and 44, and thereby the second vanes 42, 43, and 44 rotate in the advance direction against the biasing force of the return spring 70. The working fluid in the retard chambers 31, 32, and 33 is discharged to the oil pan through the retard passages 86, 87, 88, and 80. At this time, the contact portion 49 of the first vane 41 is in contact with the shoe 132. The stopper piston 70 fits in the fitting ring 71. Therefore, relative rotation of the first vane rotor 20 in the advance direction with respect to the housing 10 is limited. When the second vane 43 rotates in the advance direction and the contact portions 50, 55 contact each other, the fitting pin 56 comes to a position coaxially with the fitting hole 53. As the working fluid in the advance chamber 37 is supplied to the hydraulic chamber 57 through the advance passage 92, the working fluid pressure causes the fitting pin 56 to fit in the fitting hole 53 against the biasing force of the spring 59. Because the fitting pin 56 fits in the fitting hole 53, the second vane rotor 25 is disabled to rotate relative to the first vane rotor 20, and thereby the biasing force of the return spring 70 is limited from influencing the phase control by the valve timing adjusting device 1.

In the present embodiment, when no working fluid is supplied to the valve timing adjusting device 1 from the fluid supplier 4 in the course of or after engine stop, the limiting device disengages the first vane rotor 20 from the second vane rotor 25, and the spring force of the spring 60 causes the first vane rotor 20 and the second vane rotor 25 to rotate in opposite directions in the course of engine stop or engine start. Therefore, the phase of the valve timing adjusting device 1 becomes the advance position at the start of the engine.

When working fluid is supplied to the valve timing adjusting device 1 from the fluid supplier 4 to advance or retard the valve timing after the engine is started, the fitting pin 56 is fitted in the fitting hole 53 for engagement. The above means that the return spring 60 is fixed at a shape, and thereby the first vane rotor 20 and the second vane rotor 25 are movable integrally. Consequently, the valve timing adjusting device 1 is capable of performing the phase control only by pressure of working fluid regardless of the influence by the biasing force of the return spring 60.

The limiting device disengages the fitting pin 56 from the fitting hole 53 in the course of engine stop or start, and engages the fitting pin 56 with the fitting hole 53 after engine start. Therefore, the phase control is made by the balance between the biasing force of the return spring 60 and the pressure of working fluid only at the start of the engine. In other words, the biasing force of the return spring 60 is associated with the phase control only at the start of the engine. Due to the above reason, the biasing force of the return spring 60 is set to an average cam torque at the start of the engine at a very low temperature, and thereby the advance control of the valve timing adjusting device 1 for advancing valve timing is efficiently performed at a very low temperature.

In the present embodiment, when the engine stops and the pressure of the working fluid supplied from the fluid supplier 4 falls below the preset level, the limiting device removes the limitation on relative rotation of the first vane rotor 20 and the second vane rotor 25. In other words, when the engine stops, the limiting device disengages the first vane rotor 20 from the second vane rotor 25. The biasing device 60 biases one of the first vane rotor 20 and the second vane rotor 25 in the advance direction and biases the other one in the retard direction. Therefore, one of the first vane rotor 20 and the second vane rotor 25 moves in the advance direction and the other one moves in the retard direction. The range of the relative rotation of the second vane rotor 25 with respect to the housing 10 is limited. The above configuration causes the first vane rotor 20 to reach a target phase angle or a target position. The range of relative rotation of the first vane rotor 20 with respect to the housing 10 is limited. The above configuration causes the second vane rotor 25 to reach a target phase angle or a target position.

On the other hand, when the engine starts and the pressure of the working fluid supplied from the fluid supplier rises up to the preset level or higher, the first vane rotor 20 and the second vane rotor 25 rotate relatively with respect to the housing 10. The range of relative rotation of the first vane rotor 20 with respect to the housing 10 is limited. The above configuration causes the second vane rotor 25 to rotate relatively with respect to the first vane rotor 20. The range of relative rotation of the second vane rotor 25 with respect to the housing 10 is limited. The above configuration causes the first vane rotor 20 to rotate relatively with respect to the second vane rotor 25. When the first vane rotor 20 and the second vane rotor 25 are adjusted to be located at specified positions by the phase control, the limiting device 56 limits the first vane rotor 20 from rotating relative to the second vane rotor 25. Consequently, the biasing force of the biasing device 60 does not exert an influence on the phase control by working fluid pressure. Thus, a precise phase control by working fluid pressure is achieved. Therefore, the biasing force of the biasing device 60, which enables the phase of the valve timing adjusting device 1 to reach a target phase position at the start of the engine, can be effectively increased.

In the present embodiment, when the limiting device limits relative rotation of the first vane rotor 20 and the second vane rotor 25, both the vane rotors 20, 25 work together integrally to adjust the valve opening/closing timing in the engine. The above configuration enables the precise phase control by working fluid pressure.

In the present embodiment, when the working fluid is supplied to one of the advance chamber 37 and the retard chamber 32, the fitting pin 56 of the limiting device is brought into a fitting engagement with the fitting hole 53. Consequently, the biasing force of the biasing device 60 does not exert an influence on phase control by working fluid pressure. The above configuration enables the precise phase control by working fluid pressure.

In the present embodiment, because the fitting pin 56 is located away from the center of rotation of the first vane rotor 20, the durability of the fitting pin 56 is increased and precise phase control by working fluid pressure is effectively made.

Second Embodiment

FIGS. 10 to 15 show a valve timing adjusting device 2 according to a second embodiment of the present invention.

Figure 10:
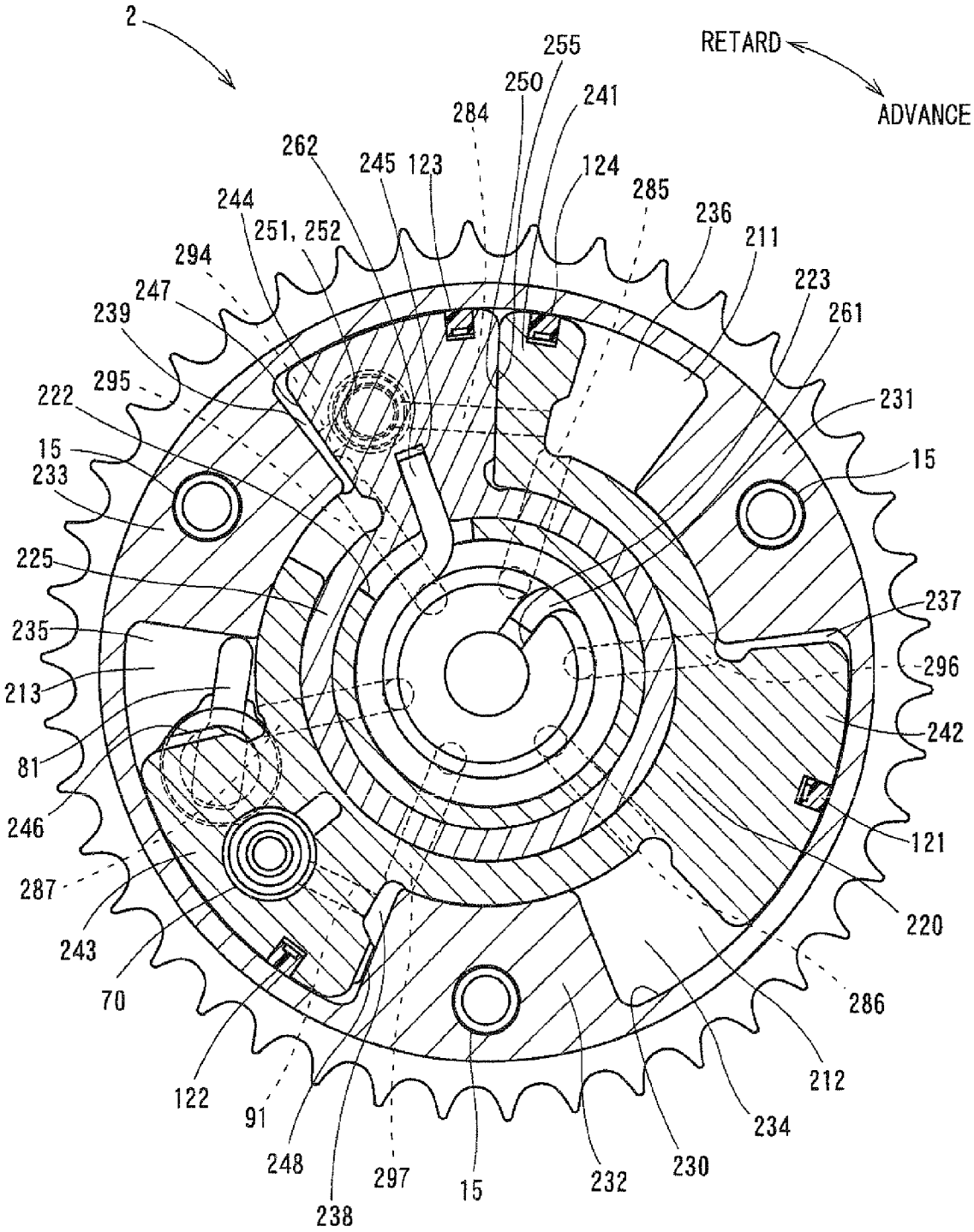
FIG. 10 shows an operational state of the valve timing adjusting device in a second embodiment of the present invention at a time immediately after engine stop.
Figure 11:
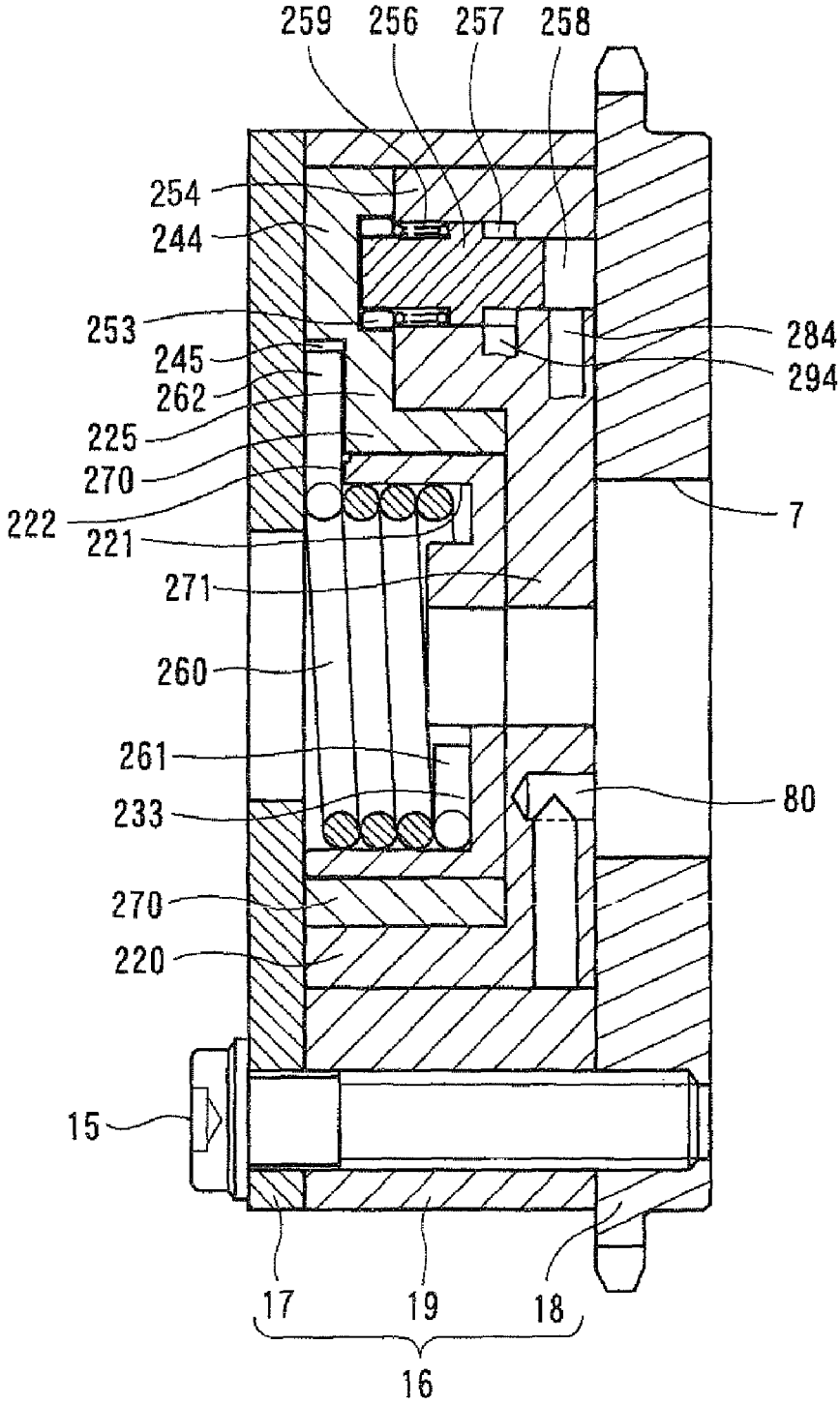
FIG. 11 shows an operational state of the valve timing adjusting device in the second embodiment at a time immediately after engine stop.
Figure 12:
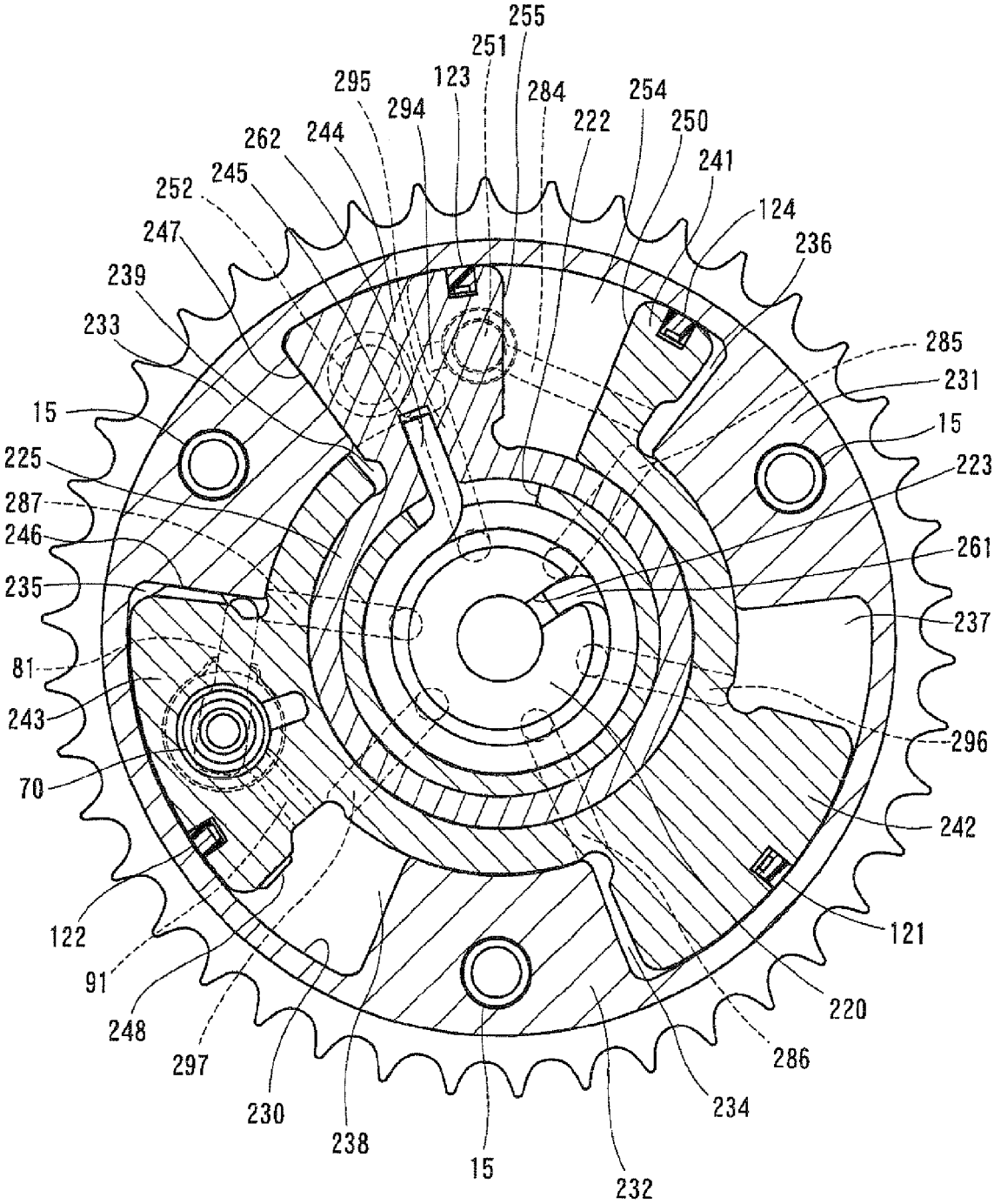
FIG. 12 shows an operational state of the valve timing adjusting device in the second embodiment in the course of or after engine stop or in the course of engine start.
Figure 13:
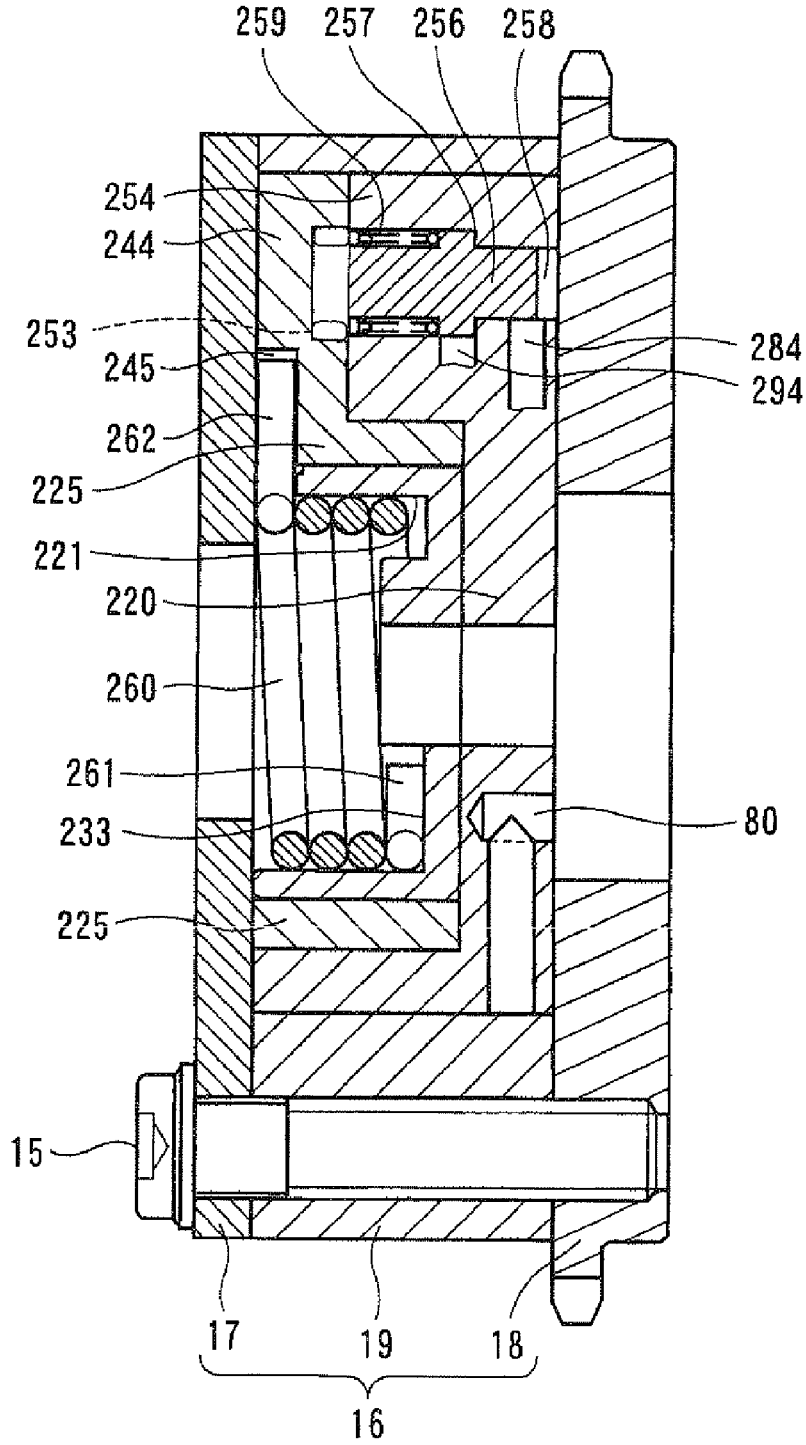
FIG. 13 shows an operational state of the valve timing adjusting device in the second embodiment in the course of or after engine stop or in the course of engine start.
Figure 14:
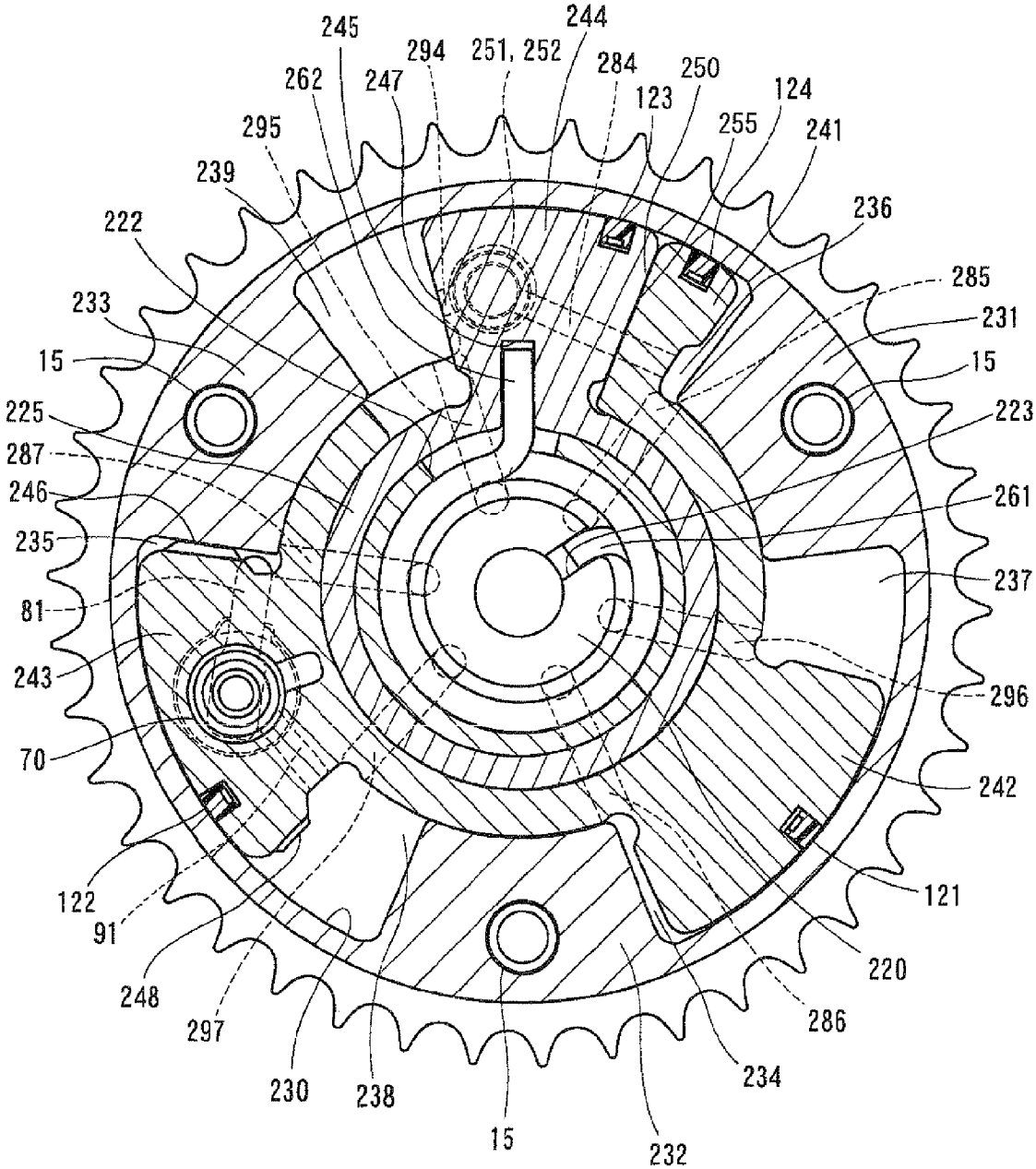
FIG. 14 shows an operational state of the valve timing adjusting device in the second embodiment after engine start.
Figure 15:
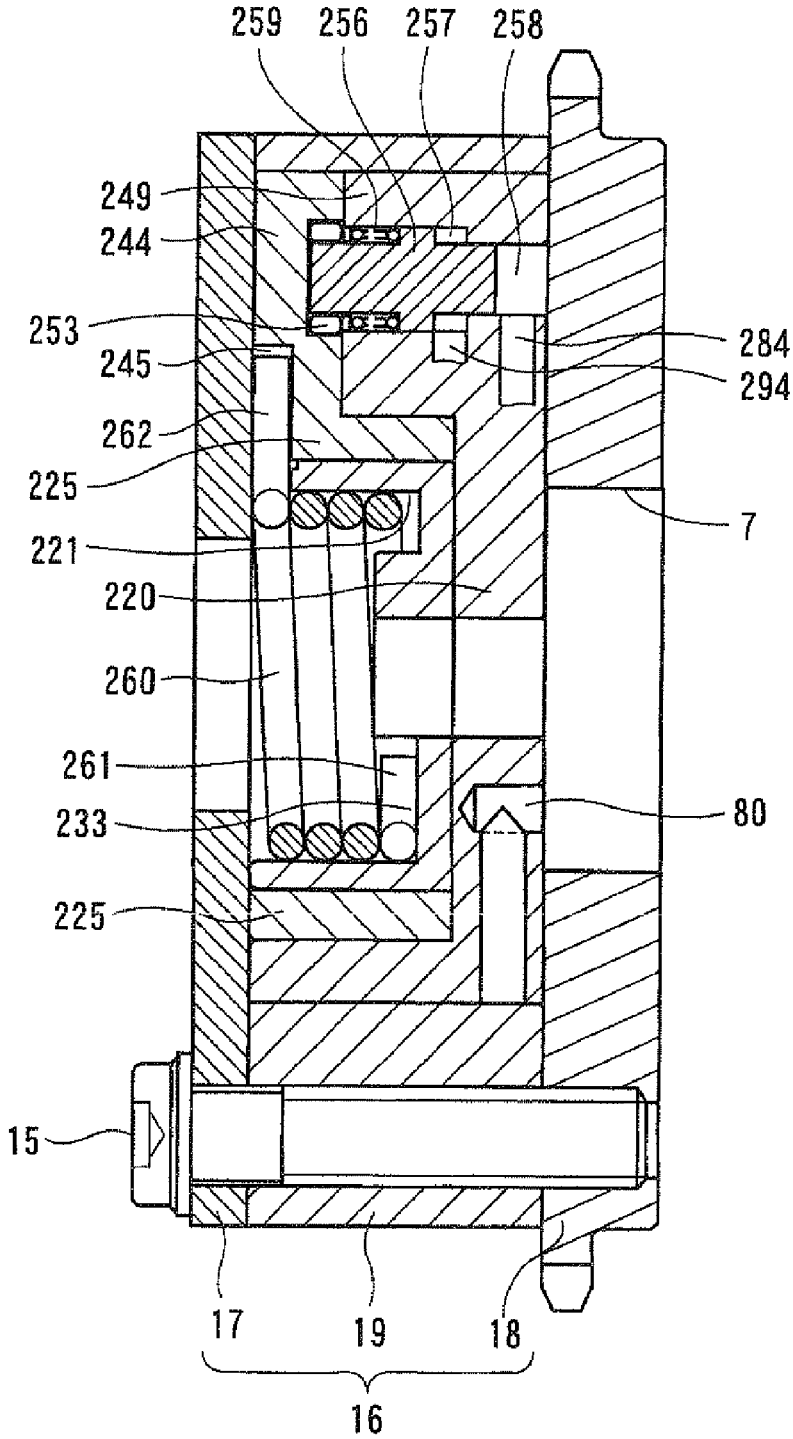
FIG. 15 shows an operational state of the valve timing adjusting device in the second embodiment after engine start.

FIGS. 10, 11 show an operational state of the valve timing adjusting device 2 at a time immediately after the engine stop, and FIGS. 12, 13 show another operational state of the valve timing adjusting device 2 in the course of engine stop, and FIGS. 14, 15 show still another operational state of the device 2 after engine start.

First, the mechanical structure of the valve timing adjusting device 2 is explained referring to FIGS. 10, 11. The components, which are substantially the same as those in the first embodiment, are designated by the same reference numerals and their description is omitted.

The valve timing adjusting device 2 in the present embodiment includes a housing 16, a first vane rotor 220, a second vane rotor 225, and a fitting pin 256 as a limiting device, and a return spring 260 as a biasing device.

The housing 16 as a driving rotator includes a chain sprocket 18, a shoe housing 19, and a front plate 17. The shoe housing 19 includes shoes 231, 232, and 233 as partition members and a circular peripheral wall 230 which are all integrally formed. The trapezoidal shoes 231, 232, and 233, which extends radially inwardly from the peripheral wall 230, are circumferentially disposed at generally regular intervals in the direction of rotation of the peripheral wall 230. A receiving chamber 211 is provided between the shoes 233 and 231, a receiving chamber 212 between the shoes 231 and 232, and a receiving chamber 213 between the shoes 232 and 233. The shoe housing 19 and front plate 17 are fixed coaxially with the chain sprocket 18 through bolts 15. Coupled with the crankshaft (not shown) serving as the drive shaft of the internal combustion engine, the chain sprocket 18 receives a driving force from the crankshaft and is rotatable together with the crankshaft. The driving force of the crankshaft is transmitted through the valve timing adjusting device 2 to a camshaft (not shown) serving as a driven shaft and opens and closes an intake valve. The camshaft is received in the chain sprocket 18 such that the camshaft is capable of rotating relatively with respect to the chain sprocket 18.

The first vane rotor 220 as a driven rotator is in contact with one axial end face of the camshaft inserted through an insertion hole 7 of the chain sprocket 18, and the camshaft and the first vane rotor 220 are coupled coaxially by a bolt (not shown). The positioning of the first vane rotor 220 and the camshaft is made by fitting a positioning pin (not shown) into the first vane rotor 220 and the camshaft or by a similar method. The camshaft, housing 16 and first vane rotor 220 rotate clockwise as viewed in FIG. 10. Hereinafter this rotational direction is referred to as the advance direction of the camshaft with respect to the crankshaft.

The first vane rotor 220 is housed in the housing 16 such that the first vane rotor 220 is rotatable relatively with respect to the housing 16. The first vane rotor 220 has a cylindrical boss 271, a receiving portion 221, and first vanes 241, 242, and 243. The boss 271 is fixed on the camshaft, and the receiving portion 221 is provided on an axial side of the boss 271 toward the front plate 17. The first vanes 241, 242, and 243 are formed on the radially outer side of the boss 271. The first vanes 241, 242, and 243 are rotatably housed in the receiving chambers 211, 212, and 213, respectively. The first vane 241 partitions the receiving chamber 211 into an advance chamber 239 and a retard chamber 236. The first vane 242 partitions the receiving chamber 212 into an advance chamber 237 and a retard chamber 234. The first vane 243 partitions the receiving chamber 213 into an advance chamber 238 (first advance chamber) and a retard chamber 235 (first retard chamber). The first vane 241 has a slidable contact portion 254 that circumferentially extends toward the advance chamber 239 from a contact portion 250 or an advance-chamber-side edge of the first vane 241 as shown in FIG. 12. Thus, the slidable contact portion 254 axially overlaps the second vane 244 of the second vane rotor 220 and slides on an surface of the second vane 244, which surface faces toward the sprocket 18. The arrows in FIG. 10, which indicate the retard and advance directions, represent the retard and advance directions of the first vane rotor 220 with respect to the housing 16. The first vane 243 has a contact portion 248, which contacts the shoe 232, and a contact portion 246, which contacts the shoe 233. The contact portions 248, 246 limit the range of rotation of the first vane rotor 220 by contacting the shoes 232, 233, respectively.

The second vane rotor 225 is located in the housing 16 coaxially with the first vane rotor 220 and fits with the radially outer side of the receiving portion 221 of the first vane rotor 220 at a position toward the front plate 17 relative to the first vane rotor 220. The second vane rotor 225 is provided to rotate relatively with respect to the housing 16 and the first vane rotor 220. The second vane rotor 225 has a boss 270, which contacts the receiving portion 221, and a second vane 244, which is provided on the radially outer side of the boss 270. The second vane 244 slidably contacts the surface of the slidable contact portion 254 of the first vane 241 in the receiving chamber 211, which surface faces toward the front plate 17. The arrows in FIG. 10, which indicate the retard and advance directions, represent the retard and advance directions of the second vane rotor 225 with respect to the housing 16. The second vane 244 partitions the receiving chamber 211 into an advance chamber 239 (second advance chamber) and a retard chamber 236 (second retard chamber). The second vane 244 has a contact portion 247, which contacts the shoe 233, and a contact portion 255, which contacts the contact portion 250 of the first vane 241. The contact portions 247, 255 limit the range of rotation of the second vane rotor by contacting the shoe 233 and the contact portion 250 respectively.

The fitting pin 256 as a limiting device is housed reciprocably in the hydraulic chambers 257, 258 of the first vane 241. The hydraulic chambers 257, 258 are provided to the slidable contact portion 254 of the first vane 241. The fitting ring 253 is held pressed in a recess formed at the second vane 244, which overlaps the slidable contact portion 254. The fitting pin 256, which has a cylindrical shape with a shoulder or a large diameter portion, is biased by a spring 259 in the direction away from the fitting ring 253 such that the fitting pin 256 is disengaged from the fitting ring 253. The biasing force of the spring 259 is set to a higher level than the working fluid pressure at the stop of the engine. The hydraulic chamber 257 is communicated with the advance chamber 239 through an advance passage 294. The hydraulic chamber 258 is communicated with the retard chamber 236 through a retard passage 284. The pressure of the working fluid supplied to the hydraulic chambers 257, 258 applied in a direction to push the fitting pin 256 into the fitting ring 253.

The fitting ring 253 is formed at a position that becomes coaxial with the fitting pin 256 when the contact portion 250 of the first vane 241 and the contact portion 255 of the second vane 244 contact each other. The fitting ring 253 is fittable with the fitting pin 256. When the fitting ring 253 and the fitting pin 256 axially overlap with each other and the working fluid pressure is equal to or higher than the biasing force of the spring 259, the fitting pin 256 is fitted into the fitting ring 253. When the working fluid pressure is equal to or less than the biasing force of the spring 259, the fitting pin 256 is taken out of the fitting ring 253.

The return spring 260 is located on the first vane rotor 220 axially on the front plate side and is compressedly housed in the receiving portion 221 that has a cylindrical shape with a bottom. A mounting groove 223 is formed in the receiving portion 221 as an inward recess in the radial direction. A mounting groove 245 is formed in the second vane 244 as an outward recess in the radial direction. The return spring 260 has one end 261 (first end), which is engaged with the mounting groove 223, and the other end 62 (second end), which is engaged with the mounting groove 245.

A notch 222 is formed in the receiving portion 221 such that the other end 262 of the return spring 260 is capable of reciprocating in the receiving chamber 211. The return spring 260 biases the first vane rotor 220 clockwise as viewed in FIG. 10 and biases the second vane rotor 225 counterclockwise. The biasing force of the return spring 260 is set to a lower level than the working fluid pressure in a normal operation of the engine in which the valve timing adjusting device 2 is mounted. Typically, the biasing force of the return spring 260 is set to an average cam torque at the start of the engine at a very low temperature.

A stopper piston 70 as a cylindrical fitting member is housed in a through hole in the first vane 243 such that the stopper piston 70 is reciprocable in the rotation axis direction. The stopper piston 70, the fitting ring, and the spring, which constitute a restriction mechanism to limit the first vanes 241, 242, and 243 and the first vane rotor 220 from rotating relative to the housing 16, are generally the same as those in the first embodiment, and thereby description thereof is omitted.

The advance passages 295, 296, and 297 supply working fluid to the advance chambers 239, 237, and 238, respectively, and discharge working fluid to an oil pan (not shown) from the respective advance chambers. The retard passages 285, 286, and 287 supply working fluid to the retard chambers 236, 234, and 235, respectively, and discharge working fluid to the oil pan (not shown) from the respective retard chambers. This means that the advance passages function as both the advance supply passages and the advance discharge passages, and the retard passages function as both the retard supply passages and the retard discharge passages. Thus, the above configuration enables working fluid to be supplied to the advance chambers 239, 237, and 238 and the retard chambers 236, 234, and 235 from the fluid supplier (not shown). Also, the above configuration enables working fluid to be discharged from the above chambers to the fluid supplier.

Next, an operation of the valve timing adjusting device will be described.

(Operation at a Time Immediately After Engine Stop)

FIGS. 10, 11 show an example operational state of the valve timing adjusting device 2 at a time immediately after the stop of the engine. In FIGS. 10, 11, the engine is stopped at a time, when the valve timing adjusting device 2 performs the retard phase control for retarding valve timing. In the valve timing adjusting device 2, working fluid has been supplied to the retard chambers 236, 234, and 235 from the fluid supplier (not shown) through the retard passages 285, 286, and 287 until immediately before the engine is stopped. Thus, the working fluid pressure has rotated the first vane rotor 220 and second vane rotor 225 in the retard direction relatively to the housing 16. Accordingly, the working fluid in the advance chambers 239, 237, and 238 has been discharged to the oil pan through the advance passages 295, 296, and 297.

At the above time, in the valve timing adjusting device 2, the working fluid in the retard chamber 236 is supplied through the retard passage 284 to the hydraulic chamber 258, and the working fluid in the advance chamber 239 is supplied through the advance passage 294 to the hydraulic chamber 257. Therefore, the pressure of working fluid in the hydraulic chambers 258, 257 is applied against a preset biasing force of the spring 259, and thereby the fitting pin 256 remains fitted into the fitting ring 253. However, the stopper piston 70 is not coaxial with the fitting ring and is not fitted into the fitting ring.

(Operation in the Course of or After Engine Stop or in the Course of Engine Start)

FIGS. 12, 13 show an operational state, where the engine stops and no working fluid is supplied to the valve timing adjusting device, and thereby the working fluid pressure is below a preset level. In the course of or after engine stop, because no working fluid is supplied to the valve timing adjusting device 2, the working fluid pressure in the hydraulic chambers 257, 258, which are communicated with the advance chamber 239 and retard chamber 236 through the advance passage 294 and the retard passage 284 respectively, falls equal to or less than the preset biasing force of the spring 259. Consequently, the fitting pin 256 is forced out of the fitting ring 253 by the biasing force of the spring 259 in the course of engine stop or start.

When the fitting pin 256 is taken out of the fitting ring 253, the return spring 260 biases the first vane rotor 220 clockwise as viewed in FIG. 12 and also biases the second vane rotor 225 counterclockwise. At this time, the contact portion 247 of the second vane 244 contacts the shoe 233, which limits relative rotation of the second vane rotor 225 in the retard direction with respect to the housing 16. Therefore, the first vane rotor 220 rotates in the advance direction relatively with respect to the housing 16. Then the contact portion 246 of the first vane 243 contacts the shoe 233, which limits relative rotation of the first vane rotor 220 in the advance direction with respect to the housing 16. Because the first vane rotor 220 is coupled with the camshaft (not shown), the phase of the valve timing adjusting device 2 becomes the advance position.

When the first vane 243 is in the most advance position, the stopper piston 70 is positioned coaxial with the fitting ring located on the chain sprocket 18, and thereby the stopper piston 70 is fitted into the fitting ring by the biasing force of the spring.

(Operation After Engine Start)

FIGS. 14, 15 show an operational state, where after the engine is started and working fluid is supplied to the valve timing adjusting device from the fluid supplier (not shown) to advance the valve timing. Working fluid is supplied from the fluid supplier through the advance passage 295 to the advance chamber 239, and thereby the working fluid pressure is applied to the second vane 244. At this time, the contact portion 246 of the first vane 243 is in contact with the shoe 233, so that relative rotation of the first vane rotor 220 in the advance direction with respect to the housing 16 is limited. Therefore, the second vane 244 rotates in the advance direction against the biasing force of the return spring 70. When the second vane 244 rotates in the advance direction, the slidable contact portion 254 of the first vane rotor 220 slides on the surface of the second vane 244, on which surface the fitting ring 253 is provided. When the contact portion 250 and contact portion 255 is brought into contact with each other, the fitting pin 256 and the fitting ring 253 become positioned coaxial with each other. The working fluid in the advance chamber 239 is supplied through the advance passage 294 to the hydraulic chamber 257, and the working fluid in the retard chamber 236 is supplied through the retard passage 284 to the hydraulic chamber 258. The working fluid pressure causes the fitting pin 256 to fit into the fitting ring 253 against the biasing force of the spring 259. Because the fitting pin 256 is fitted into or engaged with the fitting ring 253, the second vane rotor 225 is limited from rotating relative to the first vane rotor 220, and the biasing force of the return spring 70 does not exert an influence on phase control by the valve timing adjusting device 2.

In the present embodiment, even in the valve timing adjusting device 2, which has three receiving chambers in the housing 16, it is possible to limit the biasing force of the return spring 60 from exerting an influence on phase control by working fluid pressure. Furthermore, by increasing the biasing force of the return spring 60, the valve timing adjusting device 2 at the start of the engine at a very low temperature can be effectively set to a target phase position.

In the present embodiment, the fitting pin 256 is provided to the slidable contact portion 254 of the first vane 241, and the fitting ring 253 is provided to the second vane 244. Also, the fitting pin 256 and fitting ring 253 are provided to certain positions on the first vane 241 and second vane 244, which certain positions are located radially outward of the bosses 271, 270 of the first vane rotor 220 and the second vane rotor 225. Thus, durability of the fitting pin 256 and fitting ring 253 is effectively improved.

Other Embodiments

In the mechanical structure of the valve timing adjusting device 1 in the first embodiment, the first vane rotor 20 includes the first vane 41 having the contact portions 48, 49, which contact the shoes 131, 132 to limit the range of rotation of the first vane rotor 20. However, according to another embodiment of the present invention, instead of the first vane and the contact portions, the first vane rotor may alternatively have projections on the boss of the first vane rotor so that the projections contact the shoes to limit the range of rotation of the first vane rotor.

According to still another embodiment of the present invention, instead of the second vane and the contact portions, the second vane rotor may alternatively have projections on the boss of the second vane rotor so that these projections contact shoes to limit the range of rotation of the second vane rotor.

In FIG. 4, which shows the operational state of the valve timing adjusting device 1 in the first embodiment at the time immediately after engine stop, the contact portion 48 of the first vane 41 contacts the shoe 131 and the contact portion 46 of the second vane 43 contacts the shoe 133. However, alternatively in a valve timing adjusting device in still another embodiment of the invention, each of the above contact portions may have not contacted the corresponding shoes at the time immediately after engine stop.

In FIG. 10 which shows the operational state of the valve timing adjusting device 2 in the second embodiment at the time immediately after engine stop, the contact portion 248 of the first vane contacts the shoe 232. However, alternatively in a valve timing adjusting device in another embodiment of the invention, the above contact portion may not have contacted the corresponding shoe at the time immediately after engine stop.

In the valve timing adjusting device 1 in the first embodiment, after engine start, the second vane rotor 25 rotates in the advance direction and the fitting pin 56 fits in the fitting hole 53 (advance control). However, in another embodiment of the invention, after engine start, the first vane rotor 20 may alternatively rotate in the retard direction (retard control) such that the fitting pin 56 is fitted into the fitting hole 53. In the above alternative case, working fluid is supplied from the retard chamber 30 through the retard passage 81 to the hydraulic chamber 72 and the working fluid pressure causes the stopper piston 70 to be disengaged from the fitting ring 71 against the biasing force of the spring 75. The pressure of the working fluid supplied through the retard passages 80, 85 to the retard chamber 30 causes the first vane 41 to rotate in the retard direction against the biasing force of the return spring 70. The working fluid in the advance chamber 35 is discharged through the advance passages 94, 90 to the oil pan. At the above time, the contact portion 46 of the second vane 43 contacts the shoe 133 to limit relative rotation of the second vane rotor 25 in the retard direction with respect to the housing 10. Therefore, the first vane rotor 20 rotates in the retard direction and the contact portion 50 contacts the contact portion 55. At this time, the working fluid in the retard chamber 32 is supplied through the retard passage 84 to the hydraulic chamber 587 so that the fitting pin 56 fits in the fitting hole 53. Consequently, relative rotation of the first vane rotor 20 and second vane rotor 25 becomes impossible and the biasing force of the return spring 70 does not exert an influence on phase control by the valve timing adjusting device 1.

In the valve timing adjusting device 2 in the second embodiment, after engine start, the second vane rotor 225 rotates in the advance direction (advance control), and thereby the fitting pin 256 fits in the fitting ring 253. However, in still another embodiment of the invention, after engine start, the first vane rotor 220 may alternatively rotate in the retard direction (retard control) such that the fitting pin 256 is fitted into the fitting ring 253. In the above alternative case, working fluid is supplied from the retard chamber 235 through the retard passage 81, and the stopper piston 70 is disengaged from the fitting ring. The pressure of the working fluid supplied to the retard chambers 234, 235, and 236 is applied to the first vanes 242, 243, and 241. Then, the contact portion 247 of the second vane 244 is brought into contact with the shoe 233, and thereby the shoe 233 limits the second vane rotor 225 from rotating in the retard direction with respect to the housing 16. Therefore, the first vanes 242, 243, and 241 rotate in the retard direction against the biasing force of the return spring 70. Because the first vane rotor 220 rotates in the retard direction, and the contact portion 250 and contact portion 255 contact each other, the fitting pin 256 and the fitting ring 253 are brought into the position coaxial with each other. The working fluid in the retard chamber 236 is supplied through the retard passage 284 to the hydraulic chamber 258, and the working fluid in the advance chamber 239 is supplied through the advance passage 294 to the hydraulic chamber 257, so that the fitting pin 256 fits in the fitting ring 253. Consequently, relative rotation of the first vane rotor 220 and second vane rotor 225 becomes impossible, and the biasing force of the return spring 70 does not exert an influence on phase control by the valve timing adjusting device 2.

The valve timing adjusting device in any of the above embodiments controls the phase of the exhaust valve of the engine in the advance direction at the start of the engine. However, the present invention may be applied to a valve timing adjusting device which controls the phase of the exhaust valve of the engine in the retard direction at the start. It is also possible to apply the present invention to a valve timing adjusting device which controls the phase of the intake valve of the engine in the retard or advance direction at the start.

The present invention is not limited to the above embodiments and any combination of the above embodiments and various other forms of embodiments of the invention are possible without departing from the spirit thereof.

What is claimed is:

1. A valve timing adjusting device for an internal combustion engine, wherein the valve timing adjusting device is provided in a driving force transmission system of the engine, which transmits a driving force from a drive shaft to a driven shaft for opening and closing at least one of an intake valve and an exhaust valve, wherein the valve timing adjusting device adjusts timing of opening and closing the at least one of the intake valve and the exhaust valve, the valve timing adjusting device comprising:

a housing that is rotatable together with one of the drive shaft and the driven shaft, wherein the housing defines a plurality of receiving chambers therein, each of which is circumferentially defined within a given angular range;

a first vane rotor that is rotatable together with the other one of the drive shaft and the driven shaft, wherein:

the first vane rotor partitions a first one of the plurality of receiving chambers into a first retard chamber and a first advance chamber; and the first vane rotor is rotatable relatively to the housing in a retard direction and an advance direction, which is opposite to the retard direction, by pressure of working fluid supplied to the first retard chamber and the first advance chamber;

a second vane rotor that is positioned coaxially with the first vane rotor, wherein:

the second vane rotor is rotatable relatively to the drive shaft and the driven shaft;

the second vane rotor partitions a second one of the plurality of receiving chambers into a second retard chamber and a second advance chamber; and the second vane rotor is rotatable relatively to the housing in the retard direction and the advance direction by pressure of working fluid supplied to the second retard chamber and the second advance chamber;

a biasing device that has a first end engaged with the first vane rotor and a second end engaged with the second vane rotor, wherein:

the biasing device biases one of the first vane rotor and the second vane rotor in the advance direction; and the biasing device biases the other one of the first vane rotor and the second vane rotor in the retard direction; and a limiting device that allows the first vane rotor to rotate relative to the second vane rotor when pressure of working fluid supplied from an external fluid supplier is lower than a preset level, wherein the limiting device limits the first vane rotor from rotating relative to the second vane rotor when the pressure of working fluid supplied from the fluid supplier is equal to or higher than the preset level.

2. The valve timing adjusting device according to claim 1, wherein:

the first vane rotor and the second vane rotor are housed in the housing; and the first vane rotor and the second vane rotor axially overlaps with each other.

3. The valve timing adjusting device according to claim 1, wherein:

the first vane rotor defines a hydraulic chamber therein that is communicated with the second retard chamber and the second advance chamber;

the second vane rotor defines a fitting hole therein; and the limiting device includes:

a fitting pin that is axially reciprocably housed in the hydraulic chamber of the first vane rotor; and a spring that biases the fitting pin in an axial direction away from the fitting hole.

4. The valve timing adjusting device according to claim 1, wherein:

the first vane rotor includes a boss and a vane that radially outwardly projects from the boss; and the fitting pin is provided to the vane.

* * * * *